United States Patent [19]

Sanvito et al.

[11] Patent Number: 4,590,875

[45] Date of Patent: May 27, 1986

[54] MODULAR SEWING MACHINE

[75] Inventors: Roberto Sanvito; Emilio Fietta, both of Milan; Giancarlo Della Torre, Biassono, all of Italy

[73] Assignee: Rockwell-Rimoldi S.p.A., Italy

[21] Appl. No.: 692,262

[22] Filed: Jan. 17, 1985

Related U.S. Application Data

[63] Continuation-in-part of Ser. No. 524,067, Aug. 17, 1983, abandoned, which is a continuation of Ser. No. 248,588, Mar. 27, 1981, abandoned.

[30] Foreign Application Priority Data

Mar. 31, 1980 [IT] Italy ..... 21055 A/80

[51] Int. Cl.[4] ..... D05B 1/00; D05B 3/24; D05B 73/00

[52] U.S. Cl. ..... 112/168; 112/157; 112/162; 112/259; 112/260

[58] Field of Search ..... 112/157, 168, 172, 258, 112/259, 260, 162

[56] References Cited

U.S. PATENT DOCUMENTS

| | | | |
|---|---|---|---|
| 291,736 | 1/1884 | Humphrey | 112/157 X |
| 582,314 | 5/1897 | Plumley | 112/157 X |
| 2,156,547 | 5/1939 | Smith | 112/256 X |
| 2,209,338 | 7/1940 | Kessler | 112/256 X |
| 2,360,048 | 10/1944 | Christensen | 112/258 |
| 2,828,709 | 4/1958 | Heiman | 112/258 |
| 3,866,553 | 2/1975 | Adams et al. | 112/258 |

FOREIGN PATENT DOCUMENTS

| | | | |
|---|---|---|---|
| 344795 | 11/1921 | Fed. Rep. of Germany | 112/259 |
| 297664 | 6/1954 | Switzerland | 112/258 |

*Primary Examiner*—Wm. Carter Reynolds

[57] ABSTRACT

An improved modular sewing machine which has a base unit including a lower horizontal unit and a vertical upright unit to which can be attached demountable upper and lower stitching instrumentalities, the mounting surfaces of the stitching instrumentalities being substantially coplanar.

1 Claim, 6 Drawing Figures

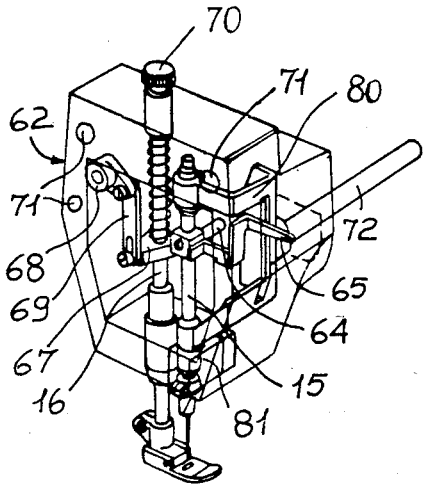
FIG. 3
FIG. 6
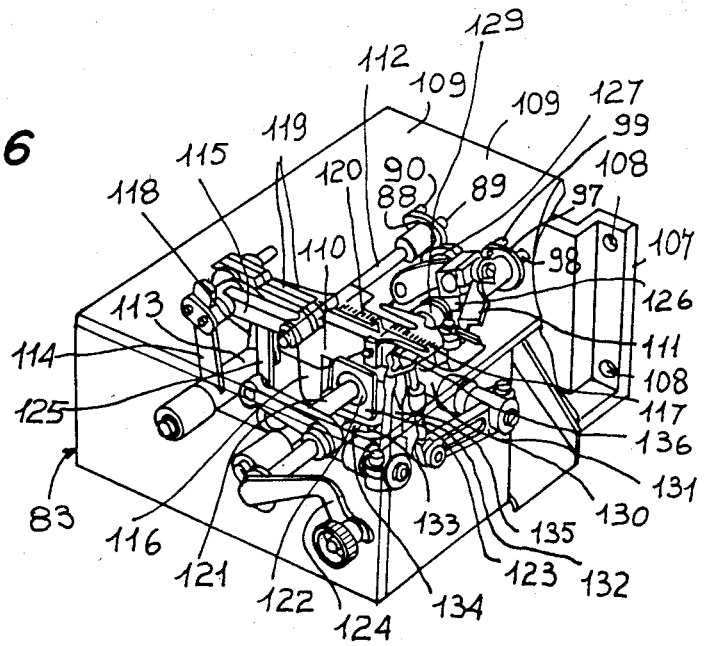

MODULAR SEWING MACHINE

REFERENCE TO COPENDING APPLICATION

This application is a Continuation-in-Part of Application Ser. No. 524,067, filed Aug. 17, 1983, which is a continuation of application Ser. No. 248,588, filed Mar. 27, 1981 both now abandoned.

BACKGROUND OF THE INVENTION

The present invention pertains to a modular sewing machine having a frame construction adapted to support the various driving elements of the machine which are necessary to actuate the stitching instrumentalities and the workpiece transport or feed dog mechanism during operation of the machine.

As is well known to those conversant in the sewing art, sewing machines are commonly identified by the particular type of stitch they are adapted to form such as straight stitches, zig-zag and overlock stitches, etc., or by the different seaming operations they are capable of accomplishing.

Additionally, it is common practice to identify sewing machines according to their type of base which may be of the conventional planar type or free arm type, etc., and signifies to those familiar with such machines the particular type of sewing operation they are capable of performing.

With industrial type sewing machines utilized for producing articles of wearing apparel, a significant problem exists relative to the versatility of such machines for generally each specific sewing operation requires one particular and well defined type of machine.

To try and correct this problem, attempts have been made to unify and simplify a number of the driving elements of the sewing machines in order to facilitate their assembly within the frame thereof.

To accomplish this, the driving elements for actuating the needle, those for effecting advance of a workpiece during seaming as well as those for the operation of the machine itself, were provided with independent supporting members which provided a means whereby the separate devices could be easily inserted and removed en bloc from within the machine's frame. Another approach was directed toward providing a simplified frame structure for sewing machines; however, this approach had its limitations for it could only be effective on machines that did not differ from one another by an appreciable amount.

In the so called "column" sewing machines in which the latter defines the usual working surface and as is well known, can have its distance from the machine's upright adjusted, it is possible to obtain a greater throat distance for the needle by inserting a spacing insert member intermediate the latter and the upright as well as by effecting movement of the column away from said upright.

A further approach well known in the art pertains to the frame that was subdivided into several interchangeable parts which are fitted together prior to complete assembly of the machine.

More precisely, this frame includes a base, an upright provided with an arm that is divided longitudinally into two parts with a first part thereof being adapted to receive the needle-carrying head and which can be assembled to the base disposed beneath it. The second part of the arm forming a cover is adapted to assemble to the first part.

From the above description of the prior art devices for converting sewing machines from one type to another, it should be readily understood that such changes require the expertise of those knowledgable in the building and repair of machines, and cannot normally be accomplished by the operators themselves. Because of this, the problem of being able to quickly and easily change a sewing machine so that it will form a different type of stitch or accommodate a different sewing operation has not been resolved.

An object of the present invention is to provide a modular type sewing machine in which its interchangeable devices can be accomplished in a minimum amount of time, and which does not require the skill of a trained technician.

SUMMARY OF THE INVENTION

The modular sewing machine according to the present invention includes a frame that is sub-divided into at least three basic units. The main unit is formed by a vertically extending upright member, one end portion of the base to which the upright assembles and a portion of the horizontal arm that extends from and which is integrally formed with the upper end of said upright member. The upper unit defines the machine's head which houses the needle and presser bars, and the lower unit defines a base extension that houses the lower stitching instrumentalities and feed dog mechanisms.

A particular advantage of the present invention is that the main unit is common to all sewing machines and includes the necessary shafting and driving elements for effecting operation of the various units adapted to assemble thereon. These various units include the upper and lower ones described above and having a specific configuration to house the necessary elements for a particular type of seaming, their housings are relatively small, easily handled and are considered substantially more economical than additional machines for each specific sewing need.

It is obvious that sewing machine manufacturers have not been concerned with the problems of apparel manufacturers who have been obliged to purchase sewing machines capable of accommodating only a limited number of sewing operations and which are specific to each type of production. Particular attention should be directed to those considered the small scale industrial manufacturers of wearing apparel where production is commonly based on small quantities of various types and who are at an obvious disadvantage with sewing machines having limited versatility. Concerning this form of disadvantage, the modular sewing machine according to the invention provides a very definite advantage relative to time saved as well as cost of additional machines for it is adapted to provide a means for direct and rapid substitution of the units to provide a desired type of seaming operation.

A characteristic of the modular sewing machine is that the main unit is provided with two distinct positioning and locking means which define mounting surfaces for the upper and lower units and being is spaced and generally vertical alignment they are formed on one side of the horizontal arm and base respectively. The upper and lower units which assemble on these mounting surfaces have positioning and locking means defining mating surfaces conforming to the mounting surfaces provided on the main unit.

This characteristic provides the definite advantage in that the sewing machine can be quickly changed from one type to another without requiring the skill of a trained technician and can be accomplished in a relatively short period of time for all that is required is to release the locking means and thence the simple substitution of the desired individual unit.

Today's production lines are subject to a high degree of flexibility and without this influencing their general activity, they can now be the object of radical machine changeovers.

Other objects and advantages of the invention will become more fully apparent by reference to the appended claims and as the following detailed description proceeds in reference to the figures and drawing wherein:

BRIEF DESCRIPTION OF THE DRAWINGS

FIG. 3 is a perspective view of an interchangeable upper unit for forming zig-zag stitches;

FIGS. 5 and 6 are perspective views of interchangeable lower units for providing sewing machines with a planar base and respectively a base for producing overlock stitching.

DESCRIPTION OF THE PREFERRED EMBODIMENT

Figure 1:
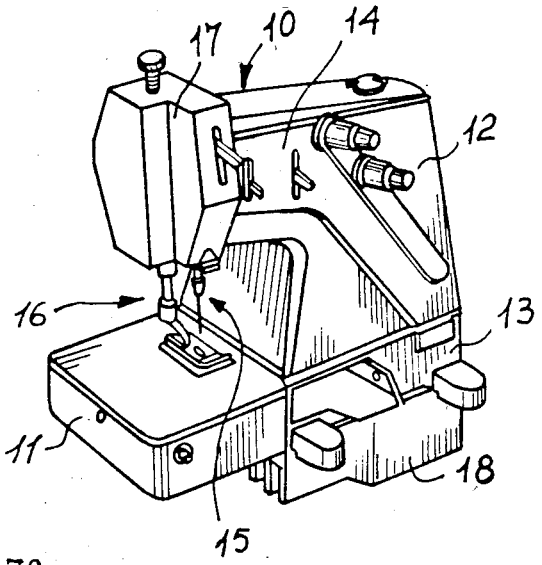
FIG. 1 is a perspective view of a sewing machine showing one type of upper and lower unit assembled to the main unit.

Referring now to FIG. 1, the frame of the sewing machine is identified generally by numeral 10 is provided internally with adequate seating elements for supporting the necessary shafting and driving members for operating the upper and lower control mechanisms between which a workpiece is caused to be advanced.

The frame 10 includes among its various parts a horizontal base unit 11 which houses the lower stitching instrumentalities and the transport or feed dog mechanism for advancing a workpiece. A vertical upright 12 assembles on a base member depicted by numeral 13 and houses the control shaft for effecting operation of the lower stitching instrumentalities as well as the feed dog mechanism. This vertical upright also houses the transmission and coupling means for the upper devices of the machine and its upper end is provided with an integrally formed horizontal arm 14 which extends in a direction so as to be disposed in spaced and overlying relationship with the base 11. The horizontal arm houses the control mechanisms for the upper stitching instrumentalities and workpiece presser device which are depicted generally in FIG. 1 by numerals 15 and 16 respectively.

The upper stitching instrumentalities and the workpeice presser device are supported by a head 17 which assembles on the free end of the horizontal arm 14. The frame also includes a sump 18 for the machine's lubricant and in a conventional manner it attaches to the underside of the base member 13. The frame 10 of the invention has been fabricated so as to be sub-divided into at least three fundamental units with each unit being provided with the specific instrumentalities which are specific to its intended function.

Figure 2:
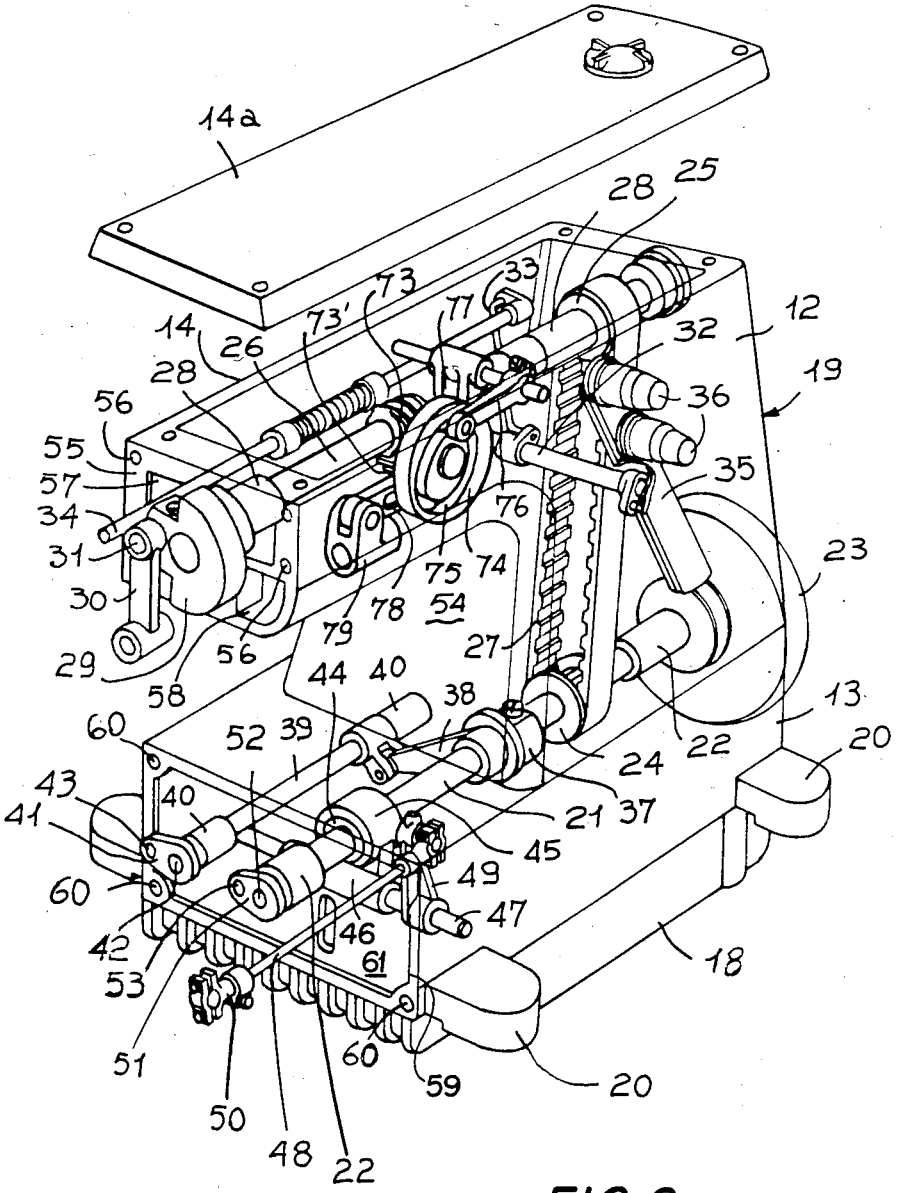
FIG. 2 is a perspective view of the main unit of a sewing machine according to the invention.

Referring now to FIG. 2, the main unit is identified generally by numeral 19 and is formed by the upright 12, the base member 13 and the horizontal arm 14 that terminates with a mounting surface for receiving the head 17 which will be identified and fully described hereinafter.

It should be understood that the main unit 19 could be formed as a one-piece casting and be provided with access doors or panels (not shown) which would be adequate for assembly and access to the various moving and driving elements contained therein.

At its upper end, the main unit is enclosed by means of a conventional cover **14*a*, and at its lower end the sump 18 provides a suitable closure for the vertical upright 12 and the associated base member 13 which includes the customary side lugs 20** that form the well known support means for the machine.

The drive mechanism contained in the upright 12 comprises the following parts: the main driving shaft 21 supported by the bearing sleeves 22 fixed to the hand wheel 23 receives the rotating motion by a motor not shown in the drawings. The driving sprocket 24 mounted on the shaft 21 transmits the motion to the driven sprocket 25 mounted on the needle bar driving shaft 26 by the ribbed belt 27 connecting the sprockets 24 and 25. The shaft 26 supported by the bearing sleeves 28 mounts the counterbalanced crank 29 to which the link 30 is pivoted in 31.

The presser bar shaft 32 actuated by a knob not shown in the drawings, is connected via the lever 33 to the presser bar lifting shaft 34. The plate 35 supports the usual thread tension device 36.

The stitch length adjusting eccentric 37 mounted on the shaft 21 is connected to the pitman 38 causing the oscillation of the feed driving shaft 39 supported by the bearing sleeves 40 and ending with the coupling drive plate 41 provided by the matching receptacle 42 and the moving receptacle 43.

The looper driving eccentric 44 mounted on the shaft 21 oscillates the pitman 45 connected to the belt crank 46 mounted on the rocker shaft 47 connected to the looper actuating rod 48 via the rocker arm 49.

The rod 48 ends with the bearing member 50 and the shaft 21 ends with the coupling drive plate 51 provided by the matching receptacle 52 and the moving receptacle 53.

Referring again to FIG. 2, the side of the main unit 19 which is identified by numeral 54 is provided with upper and lower positioning and locking means that define mounting surfaces for the upper head and lower base units which together with said main unit form the complete frame. These two mounting surfaces are disposed in spaced and generally vertical alignment.

The upper mounting surface is formed on the free end of the horizontal arm 14 and is provided with a relatively narrow peripheral planar surface 55 which forms a seat for a conventional type sealing gasket (not shown). This surface 55 is disposed so as to extend in a plane perpendicular to the axis of the shaft 26 supported within the horizontal arm 14. Surface 55 is further provided with equally spaced tapped holes 56 which are adapted to receive cap screws (not shown) that provide the locking means for the assembly of the upper head unit thereto. Within and communicating with the inner edges of the surface 55 a recessed planar surface 57 is provided which serves to enclose the end of the horizontal arm 14 and through which the counter-balanced crank 29 and the presser bar lifting shaft 34 project. The planar surface 57 also includes an opening 58 (FIG. 2) through which the necessary control elements are adapted to extend that are required for the formation of zig-zag stitches, as it will be explained later.

The lower mounting surface is formed on that portion of the base member depicted by numeral 13 which is in vertical alignment with the upper mounting surface and is provided with a relatively narrow peripheral planar surface 59 which extends in a plane perpendicular to the axis of the shaft 26 within the main unit. Surface 59, which is co-planar with surface 55, also forms a seat for a sealing gasket (not shown) and is provided with spaced tapped holes 60 which are adapted to receive cap screws (not shown) that provide the locking means for the assembly of the lower base unit thereto. Within and communicating with the inner edges of the surface 59, a recessed planar surface 61 is provided which serves to enclose the end of this portion of the base member with portions of shafts 21 and 39 and rod 48 projecting therethrough.

Figure 4:
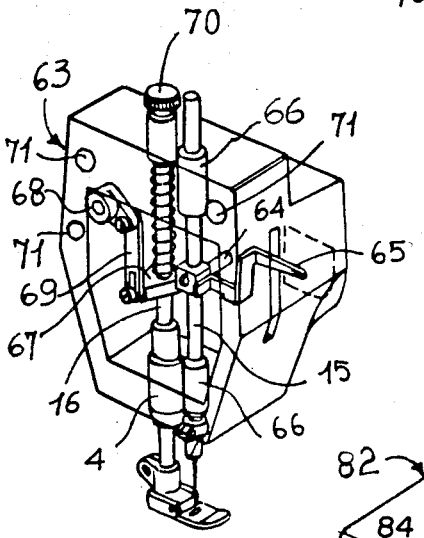
FIG. 4 is a perspective view of a interchangeable upper unit for forming straight or overlock stitches.

FIGS. 3 and 4 illustrate two different upper interchangeable head units which are the more commonly used heads for the upper stitching instrumentalities 15 and presser device 16 and are adapted to form three different types of stitches. The unit identified by numeral 62 in FIG. 3 will provide zig-zag stitches, the unit 63 in FIG. 4 utilizes a single needle to form straight or overlock stitches. Each of the upper head units utilize different components for their specific function; however, the housings or heads for each are all provided with surfaces having a configuration conforming to surface 55 of the main unit 19 and can be readily removed from or fixedly attached thereto.

As shown in FIG. 4, the upper unit 63 is provided with the upper stitching instrumentalities or needle bar 15 to which the needle bar pin 64 is fixed together with the usual thread takeup 65.

Said needle bar 15 moves alternatively along the bearing sleeves 66 parallel to the workpiece presser device or presser bar 16. The latter is connected to the presser bar block 67 moved up and down by the lifter arm 68 via the link rod 69. The knob 70 is the usual pressure adjusting device.

The upper unit 63 is further provided with equally spaced tapped holes 71 which are adapted to receive cap screws (not shown) that provide the locking means for the assembly of the upper unit to the horizontal arm 14 provided with the equally spaced holes 56, corresponding to the holes 71.

As shown in FIG. 3, the upper unit 62 is provided with the link rod 72 which provides the upper stitching instrumentalities with the conventional alternating lateral movements that are necessary in order to produce zig-zag stitches, this link rod 72 extends into the horizontal arm 14 through the opening 58 and is operatively connected to the driving members contained therein.

As shown in FIG. 2, the driving members for producing zig-zag stitches comprise the following parts to be mounted on the upright 12: the worm gear 73 fixed to the shaft 26 meshes with the worm wheel 73' fixed to the zig-zag control cam 74 provided with the groove 75 connected to the following lever 76 oscillating the zig-zag lever 77 ending in the link rod 78 connected to the collar 79. The upper unit 62 has the same parts indicated by the reference numbers as the upper unit 63, but in addition it contains the needle bar gate 80 connected to the link rod 72 for the alternating lateral movement of the needle bar 15 connected to the usual slidable guiding block 81.

Figure 5:
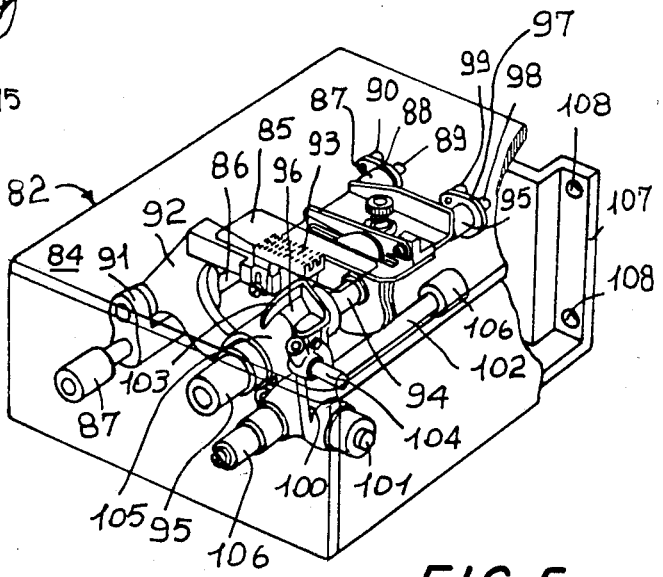

The same concept that distinguishes one upper head unit from another also applies to the lower base units, and FIGS. 5 and 6 show two different units of the commonly used type which are identified by numerals 82 and 83 respectively. These lower base units are utilized to form sewing machines having a planar base and respectively for producing overlock stitching and are formed by the portions of the base which project from the upright portion of the frame. The unit 82 provides a worksurface 84 which is relatively wide that covers the lower stitching instrumentalities and feed dog device hereinafter described. This unit 82 also has a conventional needle plate 85 mounted thereon having suitable characteristics for use with either of the upper units 62 or 63 selected and assembled onto the main unit 19.

Said lower stitching instrumentalities and feed dog device comprise the following parts: the feed shaft 86 supported on the bearing sleeves 87 is provided with the coupling driven plate 88 with matching coupling pin 89 and moving pin 90. Furthermore the oscillating feed shaft 86 has the feed rocker 91 pivoted to the feed bar 92 fixed to the feed dog 93. The rotating bed shaft 94 supported on the bearing sleeves 95 is provided with the feed lift eccentric 96 and the coupling driven plate 97 with matching coupling pin 98 and moving pin 99. Therefore the feed dog 93 is moved along an usual rectangular path.

The carrier 100 is pivoted in 101 to the looper shaft 102 is provided with the looper 103 and the looper actuating pin 104, while the shaft 94 has the eccentric 105 connected to the looper shaft 102, so that this shaft oscillates around the bearing sleeves 106 together with the looper 103. In this way the looper 103 is moved along the usual elliptical path.

The lower unit 82 is provided with a mounting flange 107 having spaced holes 108, which are in alignment with the tapped holes 60 provided in the planar surface 59.

The unit 83 provides a worksurface 109 which is adapted for producing overlock stitches and includes an appropriate needle plate 110 for such stitches that is mounted in a manner which permits utilization of a customary trimming knife 111.

The instrumentalities contained in the lower unit 83 comprise the following parts: the feed shaft 112 provided at one end with the driven plate 88 with matching coupling pin 89 and moving pin 90 and at the other end with the feed rocker 113 actuating the differential feed actuating arm 114 connected to the adjusting link 115 moving the differential feed bar 116 fixed to the differential feed dog 117. To the feed rocker 113 is fixed the main feed actuating arm 118 connected to the main feed bar 119 supporting the main feed dog 120.

The bed shaft 121 is provided at one end with the driven plate 97 with matching coupling pin 98 and moving pin 99 and with the feed lift eccentric 122 mounted in the sliding block 123 as adapted for the usual up and down movements of the feed dogs 117 and 120.

The lever 124 is connected to the link 125 for adjusting the differential feed.

The trimmer actuating pitman 126 is connected to the actuating shaft 127 fixed to the rock carrier 128 supporting the trimmer 111. Connected to the shaft 121 is the upper looper actuating pitman 129 that via the rocking shaft 130 and actuating lever 131 oscillates the upper looper carrier 132.

Similarly, connected to the shaft 121 is the lower looper actuating pitman 133 that, via the rocking shaft 134, oscillates the lower carrier 135 with lower looper 136.

The lower unit 83 is provided with a mounting flange 107 having spaced holes 108, which are in alignment with the tapped holes 60 provided in the planar surface 59.

A lower unit with a free arm type base of narrow workface and reduced length can be used, containing the same driving elements as above described with reference to the lower unit 82, FIG. 5.

As above described, interchangeable upper and lower units are provided with positioning and locking means defining surfaces having configuration conforming respectively to surfaces 55 and 59 of the main unit 19 and can be readily removed from or fixedly attached thereto.

Additionally, the lower base units also include the above described driving elements with the coupling means constituted by the driven plates 88 and 97 in the lower unit 82 which serve to operatively connect them with the drive plates 41 and 51 respectively which project outwardly from the recessed planar surface 61 of the main unit 19.

The upper units 62 and 63 when matched to the planar surface 55 with the correspondence of the holes 71 with the holes 56, the shaft 34 is connected to the lifter arm 68 and the link 30 is connected to the needle bar pin 64. Furthermore, for the upper unit 62 the link rod 72 is connected to the collar 79. lower units 82 and 83 are matched to the planar surface 59 and actuating rod 48 is joined to the coupling pin 98 to drive the feed dogs 93 and 120, respectively.

Therefore, with the present invention, it is easy to selectively convert a machine from one type to another. For example, if we want to obtain sewing machines of the type zig-zag; straight; overlock stitches, simply we have to assemble to the main unit 19 respectively the following base and upper units: 82 and 62; 82 and 63; 83 and 63.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. An improved modular sewing machine frame comprising:

(a) a base member having a vertically extending planar mounting surface formed on one side thereof;

(b) a lower horizontal base unit carrying lower stitching instrumentalites demountably secured to said mounting surface of said base member and providing a work supporting surface;

(c) a vertical upright extending upwardly from said base unit and including a horizontal arm that extends outwardly in overlying relationship with respect to said horizontal base unit and the work supporting surface thereof, said horizontal arm terminating in a vertically extending planar mounting surface that is substantially coplanar with the said mounting surface of said base unit; and (d) a head unit carrying upper stitching instrumentalities adapted to cooperate with the lower stitching instrumentalities to form stitches, said head unit being demountable secured to said planar mounting surface of the horizontal arm of said vertical upright.

* * * * *